US009109825B2

(12) United States Patent
Boarman et al.

(10) Patent No.: US 9,109,825 B2
(45) Date of Patent: Aug. 18, 2015

(54) CONVERTIBLE ICE STORAGE

(71) Applicant: Whirlpool Corporation, Benton Harbor, MI (US)

(72) Inventors: Patrick J. Boarman, Evansville, IN (US); Gregory G. Hortin, Henderson, KY (US)

(73) Assignee: Whirlpool Corporation, Benton Harbor, MI (US)

( * ) Notice: Subject to any disclaimer, the term of this patent is extended or adjusted under 35 U.S.C. 154(b) by 228 days.

(21) Appl. No.: 13/691,885

(22) Filed: Dec. 3, 2012

(65) Prior Publication Data

US 2014/0150459 A1 Jun. 5, 2014

(51) Int. Cl.

| | |
|---|---|
| ***F25C 5/18*** | (2006.01) |
| ***F25C 5/00*** | (2006.01) |
| ***F25B 21/04*** | (2006.01) |
| ***F25C 1/04*** | (2006.01) |

(52) U.S. Cl.

CPC ..... *F25C 5/182* (2013.01); *F25B 21/04* (2013.01); *F25C 1/04* (2013.01); *F25C 5/005* (2013.01); *F25C 5/18* (2013.01); *F25D 2400/02* (2013.01)

(58) Field of Classification Search

CPC ..... F25C 5/08; F25C 5/182
USPC ..... 62/344, 124
See application file for complete search history.

(56) References Cited

U.S. PATENT DOCUMENTS

| | | | | |
|---|---|---|---|---|
| 2,940,276 | A | 6/1960 | Loewenthal et al. | |
| 4,448,032 | A * | 5/1984 | Hibino et al. | 62/124 |
| 4,848,102 | A | 7/1989 | Stanfill | |
| 4,897,099 | A | 1/1990 | Ruff | |
| 4,941,902 | A | 7/1990 | Ruff | |
| 4,998,417 | A | 3/1991 | Ruff | |
| 5,011,524 | A | 4/1991 | Ruff | |
| 5,013,344 | A | 5/1991 | Ruff | |
| 5,032,157 | A | 7/1991 | Ruff | |
| 5,103,653 | A | 4/1992 | Ruff | |
| 5,123,948 | A | 6/1992 | Ruff | |
| 5,207,761 | A | 5/1993 | Ruff | |
| 5,212,957 | A | 5/1993 | Ruff | |
| 6,735,959 | B1 | 5/2004 | Najewicz | |
| 6,951,113 | B1 * | 10/2005 | Adamski | 62/3.62 |
| 7,681,406 | B2 * | 3/2010 | Cushman et al. | 62/72 |
| 8,240,159 | B2 | 8/2012 | Prabhakar et al. | |
| 2005/0061018 | A1 * | 3/2005 | Kim et al. | 62/344 |
| 2006/0168983 | A1 | 8/2006 | Tatsui | |

(Continued)

FOREIGN PATENT DOCUMENTS

| | | | |
|---|---|---|---|
| DE | 102010001465 | A1 | 8/2011 |
| DE | 102010042080 | A1 | 4/2012 |

(Continued)

OTHER PUBLICATIONS

EP Search Opinion, EP2738483, Dated Feb. 2, 2015.

(Continued)

*Primary Examiner* — Cassey D Bauer

(57) ABSTRACT

A refrigerator includes a refrigerator cabinet, an ice maker disposed within the refrigerator cabinet, an ice storage bucket and a drain positioned to capture water from the ice as it is melted. Ice may melt due to air from the refrigeration compartment or elsewhere, the ambient temperature within the ice storage bucket, or a heater thermally coupled to the ice storage bucket to melt ice stored in the ice storage bucket.

13 Claims, 7 Drawing Sheets

(56) References Cited

U.S. PATENT DOCUMENTS

| | | | |
|---|---|---|---|
| 2006/0260325 | A1 | 11/2006 | Lin |
| 2006/0260350 | A1 | 11/2006 | Van Meter |
| 2010/0126185 | A1 | 5/2010 | Cho |
| 2012/0167596 | A1 | 7/2012 | Krause |

FOREIGN PATENT DOCUMENTS

| | | | |
|---|---|---|---|
| EP | 1821051 | A1 | 8/2007 |
| EP | 2444761 | A2 | 4/2012 |
| GB | 1244831 | A | 9/1971 |

OTHER PUBLICATIONS

EP Search Opinion, EP2738484, Dated Feb. 23, 2015.
EP Search Opinion, EP2738485, Dated Feb. 2, 2015.
EP Search Opinion, EP2738496, Dated Feb. 2, 2015.
EP Search Opinion, EP2738497, Dated Feb. 2, 2015.
DE102010042080 Machine Translation from Espacenet.
DE102010001465 Machine Translation from Espacenet.
Vian, J. et. al, "Development of a Thermoelectric Ice Maker of Fingers Incorporated into a Static Domestic Refrigerator", 5th European Conference on Thermoelectrics, Sep. 10, 2007, pp. 1-6.

* cited by examiner

CONVERTIBLE ICE STORAGE

FIELD OF THE INVENTION

The present invention relates to ice makers. More particularly, but not exclusively, the present invention relates to convertible ice storage for storing ice made with an ice maker.

BACKGROUND OF THE INVENTION

Refrigerators have long provided for making ice. Yet, problems remain with the ice produced by refrigerators. For example, ice which is dispensed by a refrigerator may be of poor ice quality due to problems such as ice clumping and sublimation. What is needed is a refrigerator which addresses these problems and allows for fresh ice to be maintained.

SUMMARY OF THE INVENTION

Therefore, it is a primary object, feature, or advantage of the present invention to improve over the state of the art.

It is a further object, feature, or advantage of the present invention to provide a container for ice storage which is customized and convertible.

It is a still further object, feature, or advantage of the present invention to provide a refrigerator which provides for maintaining fresh ice in the refrigerator.

Another object, feature, or advantage of the present invention is to provide a refrigerator which avoids or reduces problems such as ice clumping and sublimation.

One or more of these and/or other objects, features, or advantages of the present invention will become apparent from the specification and claims that follow. No single embodiment need meet or provide each and every object, feature, or advantage. Different embodiments may have different objects, features, or advantages. The present invention is not to be limited by or to these objects, features, or advantages According to one aspect, a refrigerator is provided. The refrigerator includes a refrigerator cabinet, an ice maker disposed within the refrigerator cabinet, an ice storage bucket, a heater thermally coupled to the ice storage bucket to melt ice stored in the ice storage bucket, and a drain positioned to capture water from the ice melted by the heater. The refrigerator may include a fresh food compartment and a freezer compartment and the ice maker may be disposed within the fresh food compartment. The heater may be a resistance heater, a conduction heater, a side of a thermo electric cooler (TEC), a fluid warming loop, or other type of heater. A control system may be operatively connected to the heater and the control system may provide for periodically operating the heater to melt ice.

According to another aspect, a method for providing fresh ice in a refrigerator is provided. The method includes providing a refrigerator, the refrigerator having a refrigerator cabinet, an ice maker disposed within the refrigerator cabinet, an ice storage bucket, and a heater. The method further includes making ice using the ice maker, conveying the ice from the ice maker to the ice storage bucket for storage, heating the ice in the ice storage bucket using the heater to melt the ice and provide melt water, and draining the melt water from the ice storage bucket.

According to another aspect, an apparatus for making ice, the apparatus includes a housing, an ice maker disposed within the cabinet, the ice maker adapted to make wet ice or cold ice, a user selectable setting to select between making the wet ice and making the cold ice, an ice storage bucket, the ice storage bucket having an insulated upper chamber for maintaining the cold ice at a temperature below freezer, and a heater associated with the ice storage bucket to melt the wet ice stored in the ice storage bucket into melt water.

DETAILED DESCRIPTION OF THE PREFERRED EMBODIMENT

Figure 1:
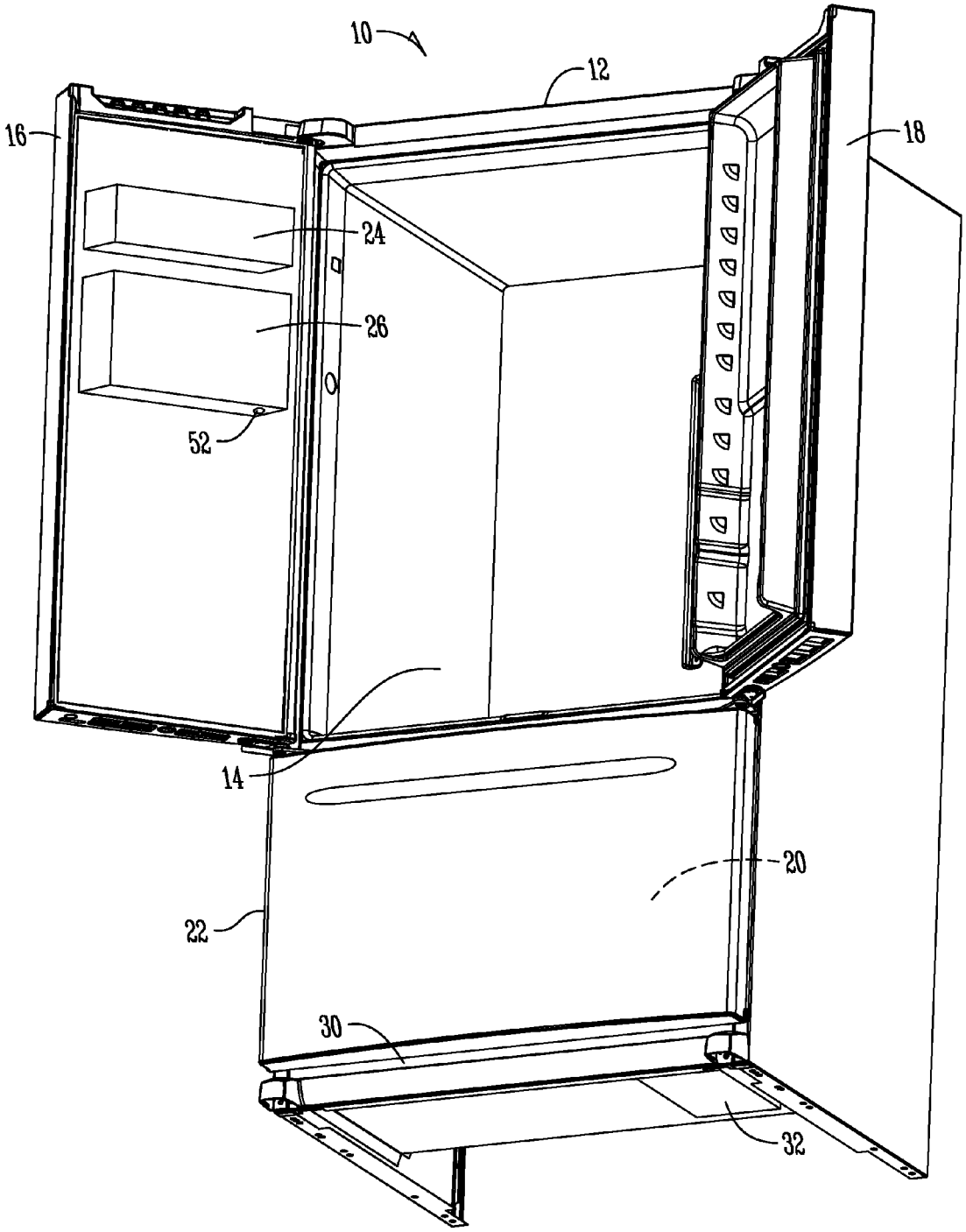
FIG. 1 illustrates one embodiment of a refrigerator.

FIG. 1 illustrates one embodiment of a refrigerator. In FIG. 1 a refrigerator 10 has a bottom mount freezer with French doors. It is should be understood that other configurations may be used including side-by-side refrigerator configurations, standalone ice maker configurations, under the counter configurations, counter-top configurations, and other types of configurations. The refrigerator 10 has a refrigerator cabinet 12. One or more compartments are disposed within the refrigerator cabinet 12. As shown in FIG. 1, a fresh food compartment 14 is shown with French doors 16, 18 providing access to the fresh food compartment 14. Below the fresh food compartment 14 is a freezer compartment 20 which may be accessed by pulling drawer 22 outwardly.

Mounted on the door 16 is an ice maker 24. An ice bucket 26 such as a container to hold or store ice is also mounted on the door 16. As shown in FIG. 1, the ice bucket 26 is positioned below the ice maker 24. Preferably, the ice maker 24 is configured to make clear ice or wet ice which is ice which is generally transparent and generally appears not to have air or other impurities. Such ice is generally made at a temperature near freezing.

There is a drain 52 in the ice storage bucket 26. To maintain the ice as clear ice, or wet ice, ice is stored in the ice storage bucket 26 temporarily and allowed to melt thereby resulting in melt water. The melt water may be separated from the ice stored in the ice storage bucket 26 and released. The melt water may then be conveyed from the ice storage bucket 26 through the drain 52 to another location. Alternatively, the melt water may be collected in the ice storage bucket 26. Although various locations are contemplated to drain the melt water, as will be discussed with respect to various embodiments, one such location is an evaporator 32 in the machine compartment 30 of the refrigerator 10. Alternatively, the melt water may be drained to evaporator trays elsewhere in the refrigerator such as in the fresh food or refrigeration compartment or the melt water may be drained to a reservoir that a user empties, or the melt water may be recycled such as to be re-frozen into cubes, dispensed as drink water, misted (such as into a crisper or other compartment), or drained from the refrigerator.

Figure 2:
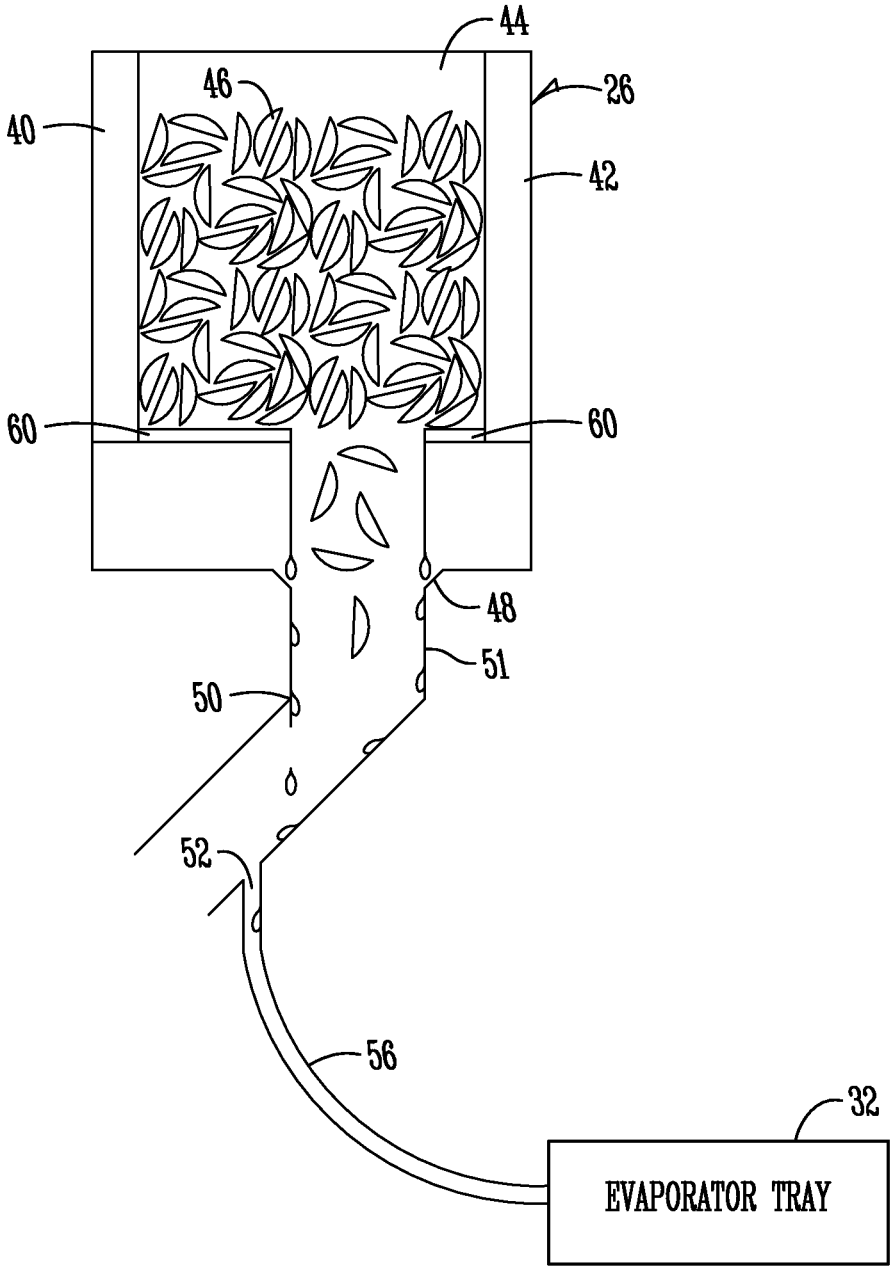
FIG. 2 illustrates one example of an ice maker with a heater.

FIG. 2 illustrates one example of an ice storage bucket 26 with ice cubes 46 stored therein. The ice storage bucket 26 may have insulated walls such as insulated upper walls 40, 42 forming an integral one piece chamber 44. A funnel 48 may be used to funnel ice 46 away from the ice bucket to another location such as to a dispenser. A drip edge 50 may be provided. As ice melts in the ice bucket 26 the melt water may be conveyed down edges of a chute 51 and may then be captured in a water trap 52. The melt water may then be conveyed through a gutter or tube 56 to an evaporator tray 32. The melt water may then be evaporated at the evaporator tray 32. The drip edge 50 may be generally above the water trap 52 so that droplets of melt water fall into or above the water trap 52.

As shown in FIG. 2 a heater 60 may be positioned within the ice storage 26. The heater 60 may provide for conductive heating and may, for example, be a warm side of thermo electric cooler (TEC) which provides for conductive heating of ice within the ice storage bucker 26. Alternatively, the heater 60 may be of other types and may be located elsewhere provided it is thermally coupled to the ice storage bucket 26 or ice associated therewith. Although a heater may be used, it is to be understood that instead of a heater refrigerator air may be ducted into the ice storage bucket 26 to melt ice or alternatively, the ambient temperature may melt ice within the ice storage bucket 26 without using additional heat sources.

Figure 3:
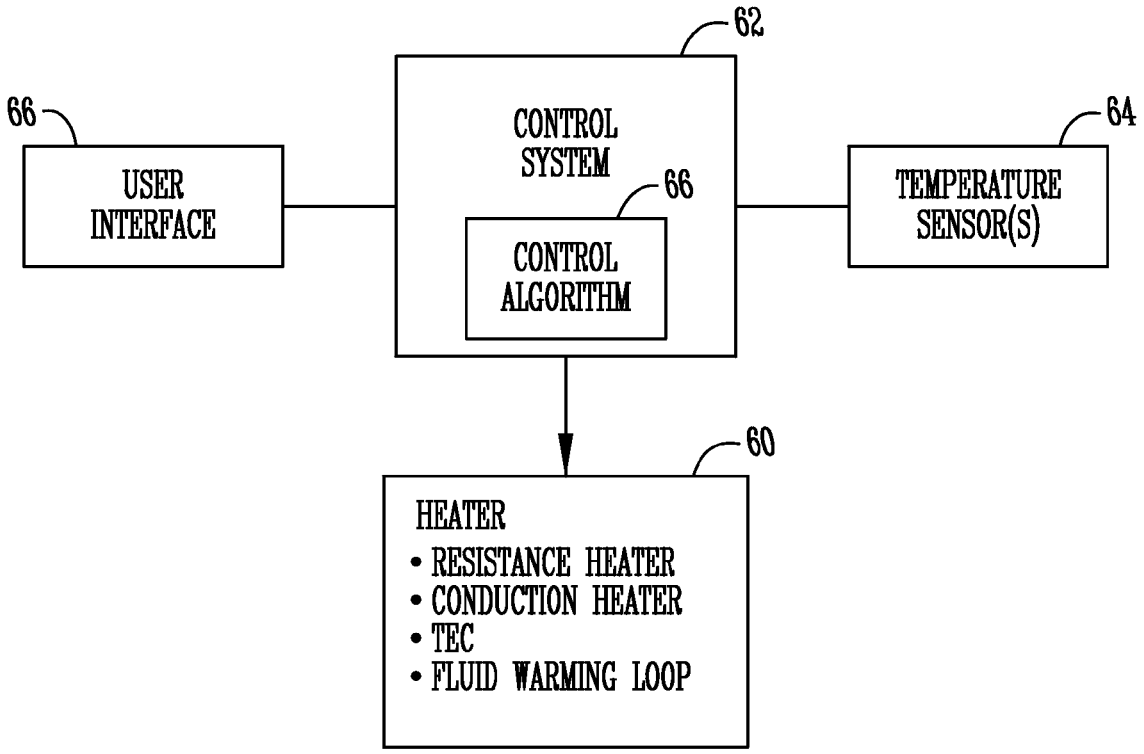
FIG. 3 illustrates a control system for operating a heater.

As shown in FIG. 3, a control system 62 which may include a microcontroller or other intelligent control may be operatively connected to the heater 60. The heater 60, where used, may be of any number of kinds such as a resistance heater, a conduction heater, a TEC, or a fluid warming loop. The heater 60 is thermally coupled to the ice storage bucket to melt ice stored therein. The control system 62 may also be operatively connected to one or more temperature sensors 64. The one or more temperature sensors may be used to sense temperature associated with the heater 60 and/or an ice storage bucket. The control system 66 may include a control algorithm 66 which may be used to periodically operate the heater 60 in order to melt the ice. The control algorithm 66 may operate in various ways. The control algorithm may take into account data from temperature sensor(s) 64. The control algorithm may also take into account the amount of ice produced, the amount of ice dispensed, the amount of melt water produced, or other information which may be measured directly or indirectly or otherwise calculated, estimated, correlated, looked-up, or otherwise computed. The control algorithm 66 may then use such information to determine when periodic heating should occur and how long the periodic heating should last. In addition, the control algorithm 66 may take into account the time of day, ice usage patterns, and predicted ice usage to reduce the likelihood of a user would dispense ice while the ice is being melted. Moreover, the control algorithm 66 may take into account energy efficiency considerations in determining when the heater 60 should be turned on, the length of time the heater 60 should be turned on, and other considerations.

A user interface 66 may also be operatively connected to the control system 66. The user interface 66 may, for example, include buttons, switches, a touch screen display, or other user controls associated with the ice and water dispenser. The user interface 66 allows for user selectable settings to be made. The user selectable settings may include the ability to select between making wet ice and making cold ice, a setting to melt ice within the ice storage bin, or other user selectable settings associated with making ice, melting ice, or conveying melt water.

Figure 4:
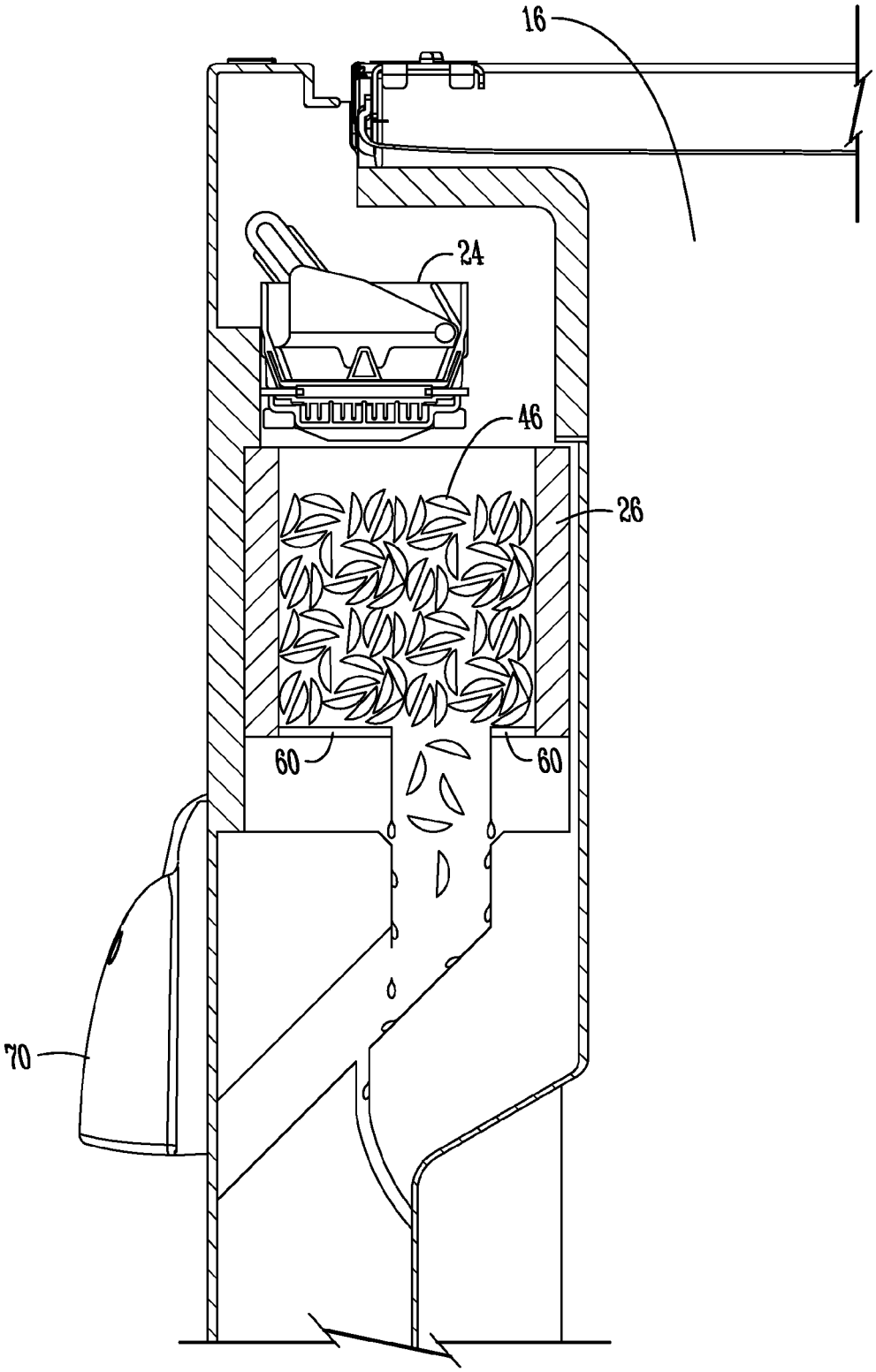
FIG. 4 is another view of an ice maker and ice storage bin within in a refrigerator.

FIG. 4 illustrates another view of a French door 16 of a refrigerator with an ice maker 24 and ice storage bucket 26 as well as a dispenser 70.

Figure 5:
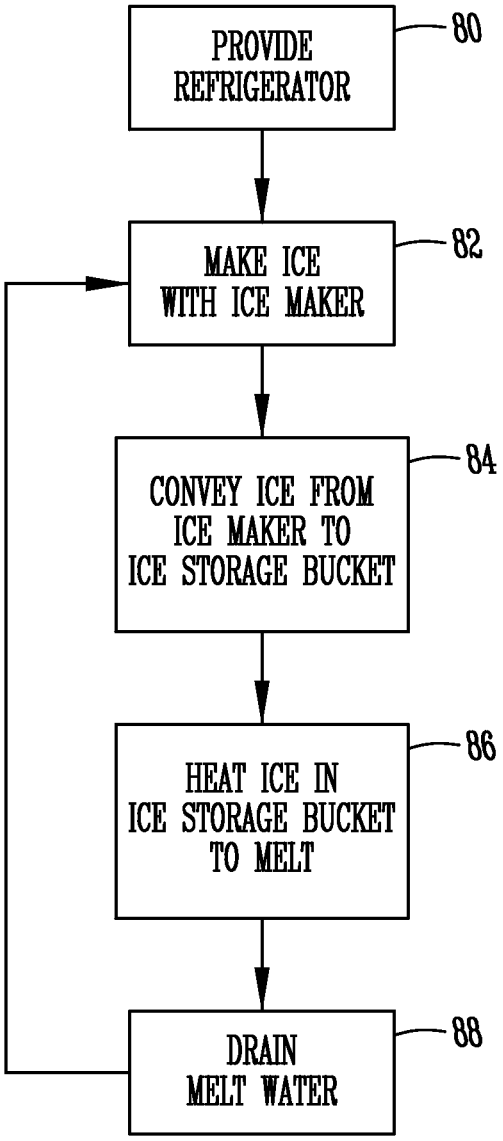
FIG. 5 illustrates one example of a method.

FIG. 5 illustrates one example of a method according to one aspect. The method allows for providing fresh ice in a refrigerator. In step 80 a refrigerator is provided. The refrigerator may include a refrigerator cabinet, an ice maker disposed within in the refrigerator cabinet, an ice storage bucket, and a heater. In step 82, ice is made using an ice maker associated with the refrigerator. The ice maker preferably is configured to make wet ice or clear ice, although the ice maker may also make cold ice or conventional ice. Wet ice or clear ice is generally created in progressive layers to avoid entrapping bubbles and is made at a temperature near the freezing point of water. In step 84, ice is conveyed from the ice maker to an ice storage bucket. In step 86, ice is heated in an ice storage bucket using a heater, ambient air, air ducted from a fresh food compartment or otherwise. Where a heater is used, the heater is thermally coupled to the ice storage bucket or the ice stored therein. The heater may be of any number of types of varieties including a resistance heater, a conduction heater, a warm side of a thermo electric cooler (TEC), or a fluid warming loop or other type of heater. It should also be understood that in order for the heater to be thermally coupled to the ice storage bucket or the ice stored therein does not require that the heater be positioned within the ice storage bucket but instead may be positioned within the ice maker or elsewhere.

Next in step 88, melt water is drained from the ice storage bucket. The melt water may be drained to any one of a number of locations. The melt water may, for example, be drained to an evaporator tray in the machine compartment of the refrigerator. Alternatively, the melt water may be drained to an evaporator in an alternative location. Alternatively, the melt water may be repurposed for other uses. For example, the melt water may be recycled to make additional ice, recycled as drinking water, misted into the refrigeration compartment, stored in a user removable container, or otherwise used.

Figure 6:
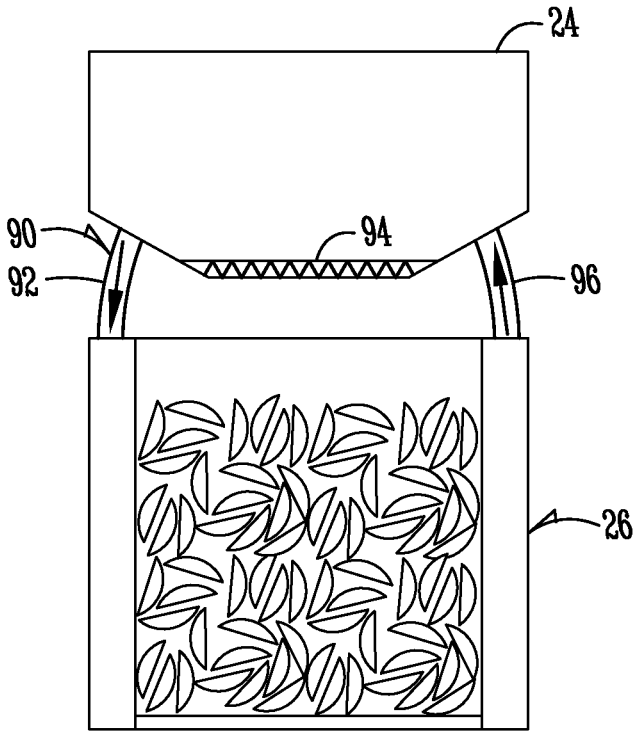
FIG. 6 illustrates an ice maker, ice storage bucket, and a fluid warming loop.

FIG. 6 illustrates another embodiment wherein a heater in the form of a fluid warming loop 90 is thermally to the ice storage bucket 26 to melt ice stored in the ice storage bucket 26. The fluid warming loop 90 may be associated with a TEC 94 associated with the ice maker 24 which warms fluid in the loop from an inlet 92 associated with the ice storage bucket 26, along one more walls or surfaces of the ice storage bucket 26 and to an outlet 92 and back to the ice maker 24. Thus, it is to be understood that the heater, where used, need not necessarily be in the ice storage bucket but may be in another location provided that the heater is thermally coupled to the ice storage bucket. It is further to be understood that the heater may operate in various ways and may use air flow, liquid flow, or otherwise use fluid flow to melt ice storage in the ice storage bucket or may use conduction heating instead as previously explained. It is to be further understood that a heater need not be used. Instead, air may be ducted from the refrigeration compartment to melt ice. Alternatively, the ambient temperature may be used to melt ice.

Figure 7:
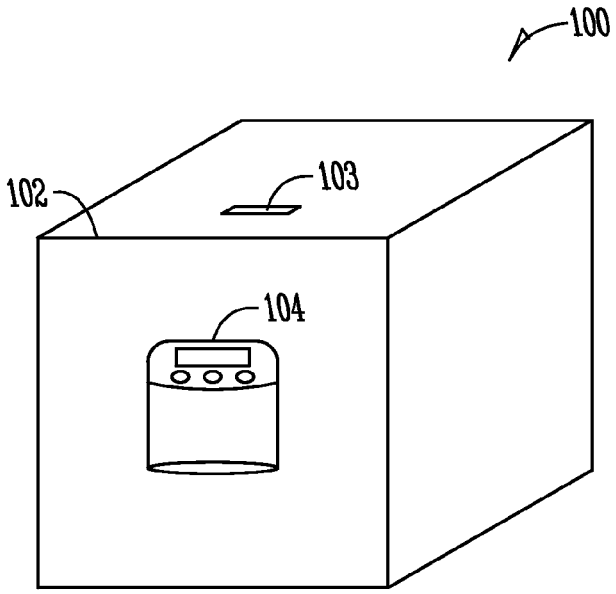
FIG. 7 illustrates one example of a counter top ice maker.

FIG. 7 illustrates another example of an appliance 100 which provides for making ice. The appliance 100 includes a counter top housing 102. There is a dispenser 104 for dispensing ice. Although a dispenser 104 is shown, the dispenser need not be included. A handle 103 may be provided for opening the counter top housing 102 to provide for additional access to the ice.

Figure 8:
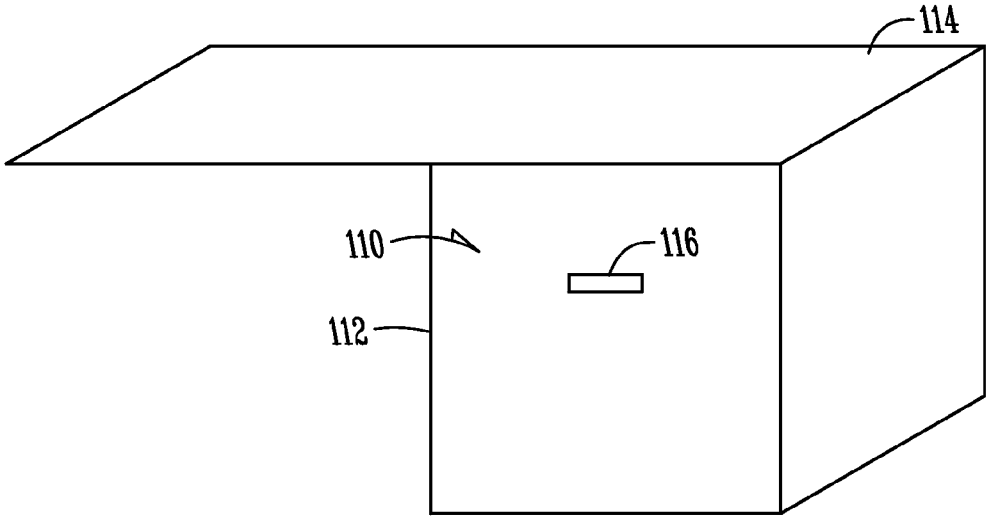
FIG. 8 illustrates another example of an under the counter housing.

FIG. 8 illustrates another example of an under the counter housing 112 which may be installed under a counter top 114. A handle 116 may be provided to provide access to within the counter housing to make ice available.

Therefore, a refrigerator or other appliance for making ice has been disclosed. The present invention contemplates numerous variations in the manner in the specific structure of an ice bucket, the type of heater and placement of the heater when used, the type of drain and placement of a drain when used, whether or not melt water is re-used or disposed of, and other options, variations, and alternatives. In general, the present invention is only intended to be limited by the scope of the following claims.

What is claimed is:

1. A refrigerator comprising:

a refrigerator cabinet;

a fresh food compartment disposed within the refrigerator cabinet;

a freezer compartment disposed within the refrigerator cabinet below the fresh food compartment;

a door providing access to the fresh food compartment;

an ice maker at the door;

an ice storage bucket at the door;

a funnel at a bottom of the ice storage bucket;

a dispenser for dispensing ice on the door;

an ice chute extending from the funnel to the dispenser;

a user interface associated with the dispenser wherein the user interface is configured to select between making wet ice with the ice maker and cold ice with the ice maker;

a heater positioned proximate the ice storage bucket to melt ice; and a drain comprising a water trap positioned along the ice chute to capture water from ice melted by the heater.

2. The refrigerator of claim 1 wherein the heater is selected from a set consisting of a resistance heater, a conduction heater, a side of a thermo electric cooler (TEC), and a fluid warming loop.

3. The refrigerator of claim 1 wherein the heater is positioned at a bottom of the ice storage bucket.

4. The refrigerator of claim 1 wherein the heater provides for conductive heating.

5. The refrigerator of claim 1 further comprising a control system operatively connected to the heater and wherein the control system provides for periodically operating the heater to melt the ice.

6. The refrigerator of claim 1 wherein the heater is positioned at the ice maker.

7. The refrigerator of claim 6 wherein the ice maker comprises an ice mold and wherein the heater provides heat used to facilitate removal of the ice from the mold and to melt the ice stored in the ice storage bucket.

8. The refrigerator of claim 1 further comprising a conduit at the drain to convey the melt water.

9. The refrigerator of claim 8 wherein the refrigerator further comprises an evaporator tray and where the conduit conveys the melt water to the evaporator tray.

10. The refrigerator of claim 1 wherein the ice storage bucket comprises an insulated upper chamber.

11. A refrigerator comprising:

a refrigerator cabinet;

a fresh food compartment disposed within the refrigerator cabinet;

a freezer compartment disposed within the refrigerator cabinet below the fresh food compartment;

a door providing access to the fresh food compartment;

an ice maker at the door;

an ice storage bucket at the door;

a funnel at a bottom of the ice storage bucket;

a dispenser for dispensing ice on the door;

an ice chute extending from the funnel to the dispenser;

a user interface associated with the dispenser wherein the user interface is configured to select between making wet ice with the ice maker and cold ice with the ice maker; and a drain comprising a water trap positioned along the ice chute to capture water from melted ice.

12. The refrigerator of claim 11 further comprising a conduit at the drain to convey the melt water.

13. The refrigerator of claim 12 further comprising an evaporator tray and where the conduit conveys the melt water to the evaporator tray.

* * * * *